US009663943B2

(12) United States Patent
Dimakis et al.

(10) Patent No.: US 9,663,943 B2
(45) Date of Patent: May 30, 2017

(54) BUILDING PRODUCTS WITH FIRE-RESISTANT CLADDINGS

(71) Applicant: WEYERHAEUSER NR COMPANY, Federal Way, WA (US)

(72) Inventors: Alkiviadis George Dimakis, Federal Way, WA (US); Travis E. Bjorkman, Bonney Lake, WA (US); Glen Robak, Bonney Lake, WA (US); Jack G. Winterowd, Puyallup, WA (US); Erik M. Parker, Bonney Lake, WA (US); Derik Rieger, Federal Way, WA (US)

(73) Assignee: Weyerhaeuser NR Company, Seattle, WA (US)

( * ) Notice: Subject to any disclaimer, the term of this patent is extended or adjusted under 35 U.S.C. 154(b) by 0 days.

(21) Appl. No.: 14/862,369

(22) Filed: Sep. 23, 2015

(65) Prior Publication Data

US 2017/0081844 A1 Mar. 23, 2017

(51) Int. Cl.
*E04B 1/94* (2006.01)
*E04B 1/26* (2006.01)

(52) U.S. Cl.
CPC ..... *E04B 1/944* (2013.01); *E04B 1/26* (2013.01)

(58) Field of Classification Search
CPC ..... E04B 1/944; E04B 1/26
See application file for complete search history.

(56) References Cited

U.S. PATENT DOCUMENTS 3,425,658 A * 2/1969 Simmons ..... E04B 1/944 249/15
3,908,327 A * 9/1975 Quigg ..... E04B 1/944 52/359
5,256,222 A * 10/1993 Shepherd ..... B28B 3/123 106/631
5,968,669 A 10/1999 Liu et al.
6,010,596 A * 1/2000 Song ..... C04B 28/14 106/660
6,245,842 B1 6/2001 Buxton et al.
8,458,971 B2 6/2013 Winterowd et al.
2006/0174798 A1* 8/2006 Churchill ..... C09D 5/20 106/2
2007/0276074 A1* 11/2007 Van Dine ..... B60R 13/08 524/437
2008/0250741 A1* 10/2008 Bennett ..... C08L 97/02 52/506.01
2013/0000239 A1* 1/2013 Winterowd ..... E04B 1/94 52/515
2015/0111052 A1 4/2015 Parker et al.

FOREIGN PATENT DOCUMENTS

CA EP 0500999 A2 * 9/1992 ..... D21H 11/02
GB 956060 A * 4/1964 ..... E04B 1/944
GB 1331433 A * 9/1973 ..... E04B 1/944
GB 1358853 A * 7/1974 ..... E04B 1/944
GB 1413016 A * 11/1975 ..... E04B 1/944

* cited by examiner

*Primary Examiner* — Elizabeth A Quast
(74) *Attorney, Agent, or Firm* — Perkins Coie LLP

(57) ABSTRACT

A building product having improved fire resistance by virtue of solid fire-resistant cladding material attached to at least a portion of one or more surfaces of the building product. The solid fire-resistant cladding material includes wood fiber and binder. The building product can be a wood-based building product, and can be in the form of an I-joist. When an I-joist is used, the solid fire-resistant cladding material can be attached to, for example, the web of the I-joist.

23 Claims, 9 Drawing Sheets

BUILDING PRODUCTS WITH FIRE-RESISTANT CLADDINGS

TECHNICAL FIELD

The present technology is related to building products with solid fire-resistant claddings and methods of preparing the same. In particular, the present technology is related to beams, joists, or other structural members having solid fire-resistant cladding on or otherwise covering at least a portion of a structural member, such as the web of wood I-joists.

BACKGROUND

Building codes include fire protective provisions for all types of construction to prevent fires and mitigate damage. For example, building codes typically include detailed recommendations and/or requirements regarding structural designs, assemblies, sprinkler systems, smoke detectors, and other factors related to igniting and containing fires in a building.

Wood-based I-joists are used in approximately 50% of US single family homes, and in particular for raised floor and first-floor-over-basement construction. For finished basements that are built with I-joists, one layer of drywall covering the I-joists typically meets the fire provisions of the building code with respect to the use of I-joists. However, with unfinished basements where the I-joists are not covered by dry wall, builders need cost effective solutions for meeting the I-joist fire protective provisions of many building codes.

One option for meeting fire protective provisions in unfinished floor-over-basement construction is to use solid sawn construction materials. However, solid sawn construction materials suffer from a relatively high incidence of call backs.

Another option is to coat I-joists with fire resistant coatings. Such coatings are typically liquid materials that are sprayed, brushed, or painted on I-joists, and the coating may harden to some degree after application. Examples of such coatings are described in U.S. Pat. Nos. 5,968,669; 6,245,842; and 8,458,971, and U.S. Published Patent Application No. 2015/0111052. However, although such coatings may perform well on I-joists in some fire resistance tests, they do not necessarily perform well on others. For example, a coating that is relatively non-combustible may prevent the spread of a flame along its surface (in accordance with, e.g., ASTM E2768), but may do very little to protect the substrate from heat degradation (e.g., as required by ASTM E119). Conversely, a coating that rapidly expands when exposed to heat or flame may not prevent a flame from traveling along its surface. Another issue is that many of the flame resistant coatings are applied in the field, which is laborious and time consuming.

Ultimately, the construction industry needs improved and cost effective ways to enhance the fire endurance properties of building products.

DETAILED DESCRIPTION

Figure 1:
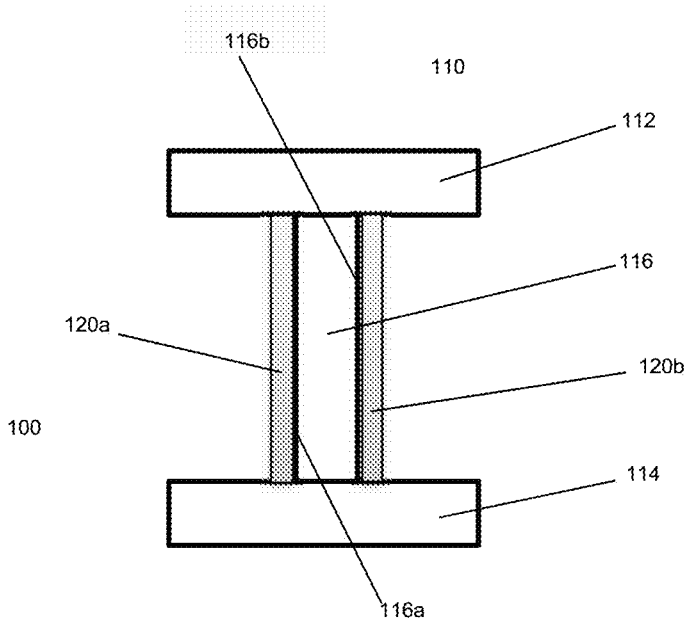
FIG. 1 illustrates an I-joist with solid fire-resistant cladding material in accordance with some embodiments described herein.

Several embodiments of fire-resistant building products having solid fire-resistant cladding material are described below. Components of the solid fire-resistant cladding material include a wood fiber matrix and one or more binders, such as emulsion binder, and in some embodiments, may additionally include starch. Additional components of the solid fire-resistant cladding material can include fire retardants, graphite particles, clay particles, colorants, and combinations thereof. These components can be integrated with the solid fire-resistant cladding material and/or applied to one or more surfaces of the cladding material or other surfaces of the building product. The fire-resistant cladding material is secured to one or more surfaces of a structural member, such as a joist. In some embodiments, the cladding material covers one or more surfaces of the structural member that is expected to be exposed to heat and/or fire in the event of a fire.

In some embodiments, the structural member is a joist. Any type of joist can be used, including an I-joist. The material of the structural member is generally not limited, and in some embodiments, the structural member is a wood-based material. In some embodiments, the structural member is a wood-based I-joist having a top flange, a bottom flange, and a web between the top flange and the bottom flange. The solid fire-resistant cladding material can be attached to either or both of the main surfaces of the web. The solid fire-resistant cladding material can also be attached to the bottom surface of the bottom flange. In some embodiments, solid fire-resistant cladding material is attached to the I-joist so that cladding material extends along each side of the web from the underside of the top flange to the topside of the bottom flange to thereby encase the web.

Several embodiments of the present technology are directed to methods of improving the fire-resistance of building products. In one embodiment, the method includes disposing a solid fire-resistant cladding material on at least one surface of a structural member, such as on the web of an I-joist. The method can optionally include preparing the solid fire-resistant cladding material before disposing it on a surface of the structural member (e.g., by coating one or more surfaces of the cladding material) and/or securing the cladding material to the structural member via chemical, mechanical, or physical means.

The present technology improves the fire-resistance of a building product by disposing a solid fire-resistant cladding material on at least a portion of a surface of a structural member of the building product. The specific material of the structural member is generally not limited, and in some embodiments, is any type of material used in building construction projects. Similarly, the form, shape, dimensions, size, and/or construction of the structural member or the finished building product is generally not limited.

In some embodiments, the structural member is a wood product. As used herein, the term "wood product" includes products manufactured from logs (e.g., lumber). The term "wood product" also includes composite wood products, which includes a wide range of derivative wood products manufactured by binding together strands, particles, fibers, or veneers of wood, with adhesives to form composite materials. Non-limiting examples of composite wood products include glulam, plywood, parallel strand limber (PSL), oriented strand board (OSB), oriented strand lumber (OSL), laminated veneer lumber (LVL), laminated strand lumber (LSL), particleboard, medium density fiberboard (MDF), and hardboard.

Other materials which can be used for the structural member include, but are not limited to, wood/plastic composites, gypsum, steel (including light gauge steel framing and steel beams and columns), aluminum, and concrete The form of the building product is generally not limited, provided the form includes a surface on to which the cladding material may be disposed. The surface may be planar or non-planar. Non-limiting examples of different forms of the building products include floor joists, roof rafters, headers, beams, trusses, mouldings, and rimboard.

In some embodiments, the building product is an I-joist including a top flange, a bottom flange, and a web extending between the top flange and the bottom flange. The web includes a first surface and a second surface opposite the first surface. The first and second surfaces of the web are suitable locations to which the cladding material may be attached. The I-joist can be made of wood or any other suitable material.

The fire-resistant cladding material is generally a solid, sheet-like material that is pre-formed and cut into a desired shape and size for application to the structural member. Unlike a coating material, which is typically a liquid or viscous material applied via brushing, spraying, or the like, the cladding is a pre-formed material having a defined shape (e.g., a fixed-volume or relative firm material). Sheets of the cladding material may be flexible and bend, but the material is a solid that does not have the flowing properties of a fluid.

The cladding material can have many different shapes, sizes, and dimensions as desired by the user and as applicable to the end use. In some embodiments, the thickness of cladding material is in the range of from 0.1" to 3.5". In some embodiments, the cladding material has a thickness in the range of from 0.1" to 1.0". In some embodiments, the cladding material has a thickness in the range of from ⅜" to ½". In some embodiments, the thickness of the cladding material is in the range of from 0.46" to 0.50". In some embodiments, the thickness of the cladding material is based on the thickness of the web of the I-joist to which it is attached. For example, the thickness of the cladding material can be slightly less than the thickness of the web, which can help to facilitate manufacturing. The exact thickness of the cladding material may depend on the building product to which it is applied, the intended use, and/or performance requirements. In some embodiments, the building product needs limited protection and therefore a relatively thin cladding material may be suitable. In other situations (e.g., an exposed floor assembly), more protection is required and thus a thicker cladding is appropriate.

In several embodiments, the solid fire-resistant cladding material includes a wood fiber matrix and a binder. These components are generally combined into a slurry and then shaped, pressed, and/or dried into a final structure. In some embodiments, atmospheric refiners are used to grind the wood fiber in a water medium, after which binder is added to the slurry. A mat of the slurry is prepared and consolidated in a closed-loop water system and then dried to a target moisture content.

The wood fiber used for the wood fiber matrix component of the solid fire-resistant cladding material can be any suitable wood fiber material. In some embodiments, the wood fiber is prepared from refined wood chips or paper waste. The wood fiber matrix generally serves as the primary component of the cladding material and provides bulk and structure to the cladding material. In some embodiments, the wood fiber is present in the cladding material in a range of from 50 to 99 wt %.

The binder of the cladding material binds together the various components of the cladding material. One or multiple types of binders can be used. Binders suitable for use in binding together wood fiber can be used for the cladding material. In some embodiments, the binder is an emulsion, such as a wax emulsion or paraffin emulsion. In some embodiments, the binder is present in the cladding material in a range of from 1 to 10 wt %.

Starch can be another component included in the cladding material. Starch can be provided in the cladding material to increase the material's strength. In some embodiments, the starch is present in the cladding material in a range of from 1 to 10 wt %.

The solid fire-resistant cladding material can further include components that impart additional properties to the material. For example, a fire retardant material can be added to the cladding material and/or sprayed on a surface of the cladding material or any other surface of the building material. One suitable fire retardant material used is boric acid, but other fire retardant materials that can be incorporated into the cladding material are also suitable. In other embodiments, the cladding material includes dyes or colorants for imparting a desired color to the cladding material. In another example, the cladding material can include graphite particles to increase fire resistance, either in addition to or in lieu of fire retardant materials and/or dyes.

The cladding material can further include surfactants, wetting agents, opacifying agents, moisture scavengers, viscosifying agents, catalysts, preservatives, fillers, diluents, hydrated compounds, halogenated compounds, acids, bases, salts, borates, melamine, and other additives that might promote the production, storage, processing, application, function, cost and/or appearance of the cladding material.

In some embodiments, the cladding material has a relatively high permeability as compared to other building materials. For example, in some embodiments, the permeability of the cladding material is greater than 20 perms. A high permeability generally means water can more readily pass through the material, which thereby decreases the chance water will get trapped at an interface between the cladding material and the structural member.

In some embodiments, the cladding material has an improved drying rate as compared to other traditional construction materials. As used herein, the term drying rate means the percentage of water lost per hour when a wet material is allowed to dry under 50% relative humidity conditions. In some embodiments, the cladding material described herein has a drying rate greater than the drying rate of 7/16" OSB having a density of 42 lbs/ft$^3$ (drying rate=60%/hour) and at least two times better than the drying rate of ½" gypsum board (drywall) having a density of 34 lbs/ft$^3$ (drying rate=26%/hour). In some embodiments, the drying rate of the cladding material is approximately 68%/hour. The method for calculating drying rate is discussed in greater detail in Example 3 below.

In some embodiments, the cladding material has a relatively low density, which makes the cladding material lighter and generally easier to work with. In some embodiments, the density of the cladding material is from 12 to 45 lbs/ft$^3$, or from 12 to 25 lbs/ft$^3$. Densities in this range mean the cladding material is less dense and less heavy than many typical construction materials, including drywall.

In some embodiments, the cladding material also has beneficial sound deadening properties. For example, the cladding material can have sound deadening properties of up to STC 68. The cladding material can also have improved thermal resistance, such as an R value of greater than 2/in.

Various solid fire-retardant cladding materials in accordance with the description provided herein are available commercially. Suitable commercially available cladding materials include Isoltop® HD Natural and SECURpan® manufactured by Matériaux Spécialisés Louiseville, Inc, and Structodek® manufacture by Blue Ridge Fiberboard.

In some embodiments, various coatings are applied to the solid fire-resistant cladding material after it is formed to impart additional fire resistance. For example, a fire-retardant coating can be applied to either or both of the major surfaces of the cladding material. Any suitable fire-retardant coatings can be used, and the coating can be applied to the cladding material in any suitable manner (including before or after the cladding is disposed on building product). In some embodiments, the coating is a latex-based coating, such as a coating including an aqueous latex polymer. In some embodiments, the coating includes a halogen-containing compound. Any suitable coating used can further include solid particles, such as intumescent material. In some embodiments, the intumescent material is graphite.

Coating material as described above can also be applied to any other surface of the structural member, in any combination. In some embodiments, the coating material is applied to surfaces not covered by cladding material. In some embodiments, the coating material is applied to surfaces that are then covered by cladding material.

The solid cladding material can be disposed on the structural member using any suitable method for temporarily or permanently securing the cladding material to the structural member. In several embodiments, a mechanical fastening technique is used, such as through the use of staples, nails, screws, or the like, which pass through the interface between the cladding material and the structural member in order to secure the cladding material to the structural member. In other embodiments, an adhesive, bonding agent or other chemical fastening technique is used on the interface between the cladding material and the structural member. In additional embodiments, a physical fastening technique is used, such as through a friction fit between the solid cladding material and the structural member. For example, in some embodiments, a sheet of the cladding material is cut to be the same height as the web of an I-joist. The cladding is then placed on the web in such a manner that the top flange and bottom flange effectively hold the cladding in place on the web by virtue of a friction fit between the top flange, the bottom flange, and the upper and lower edges of the cladding material. The cladding material may be cut into any desired shape and/or size to help secure the cladding material to the structural member. A person skilled in the art will understand that mechanical, chemical, and physical fastening techniques can be combined to attach the cladding material to the structural member.

FIG. 1 illustrates a building product 100 in accordance with an embodiment of the technology having a structural member 110, such as an I-joist, and first and second portions of a solid fire-resistant cladding material 120*a* and 120*b* (identified collectively as cladding material 120 herein) disposed thereon. In the embodiment shown in FIG. 1, the structural member 110 includes a top flange 112, a bottom flange 114, and a web 116 between top flange 112 and the bottom flange 114. The top flange 112 is attached to the top edge of the web 116, and the bottom flange 114 is attached to the bottom edge of the web 116. The web 116 includes a first web surface 116*a* and a second web surface 116*b* opposite the first web surface 116*a*. The first portion of solid fire-resistant cladding material 120*a* is attached to the first web surface 116*a*, and the second portion of solid fire-resistant cladding material 120*b* is attached to the second web surface 116*b*. In FIG. 1, the cladding material 120 completely covers the surface area (e.g., 100% coverage) of each of the first and second web surfaces 116*a-b*. In other embodiments, the cladding material 120 may cover less than 100% of the surface area of first and second web surfaces 116*a-b*, such as from 50% to 99% of the surface area.

Figure 2:
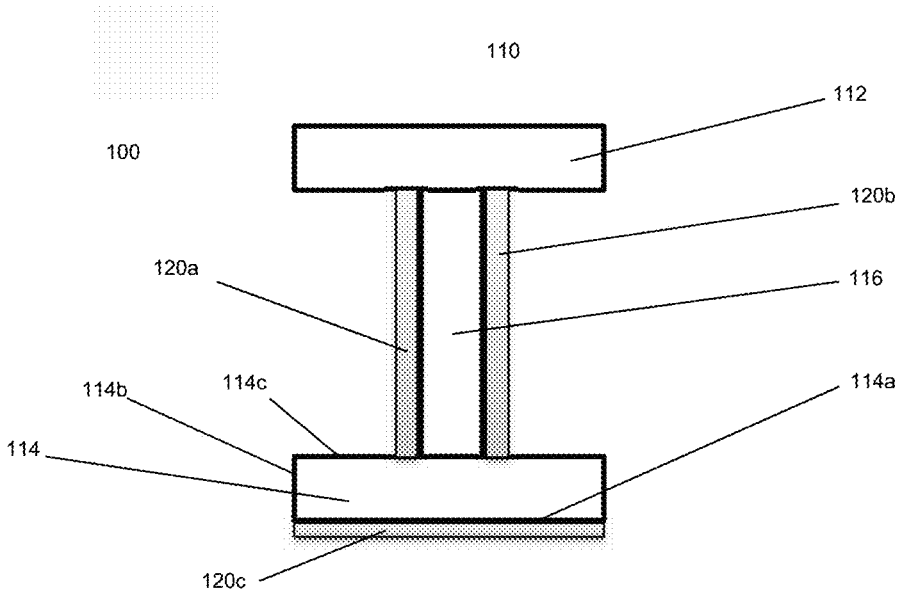
FIG. 2 illustrates an I-joist with solid fire-resistant cladding material in accordance with some embodiments described herein.

FIG. 2 illustrates an alternative embodiment of the building product 100 that is similar to the embodiment shown in FIG. 1, but the embodiment shown in FIG. 2 further includes a third portion of solid fire-resistant cladding material 120*c* attached to a bottom surface 114*a* of the bottom flange 114 of the structural member 110. Although not shown in FIG. 2, the side portions 114*b* and top portions 114*c* of bottom flange 114 can also be covered with cladding material 120 to thereby protect all of exposed surfaces of the web 116 and the bottom flange 114.

Figure 3:
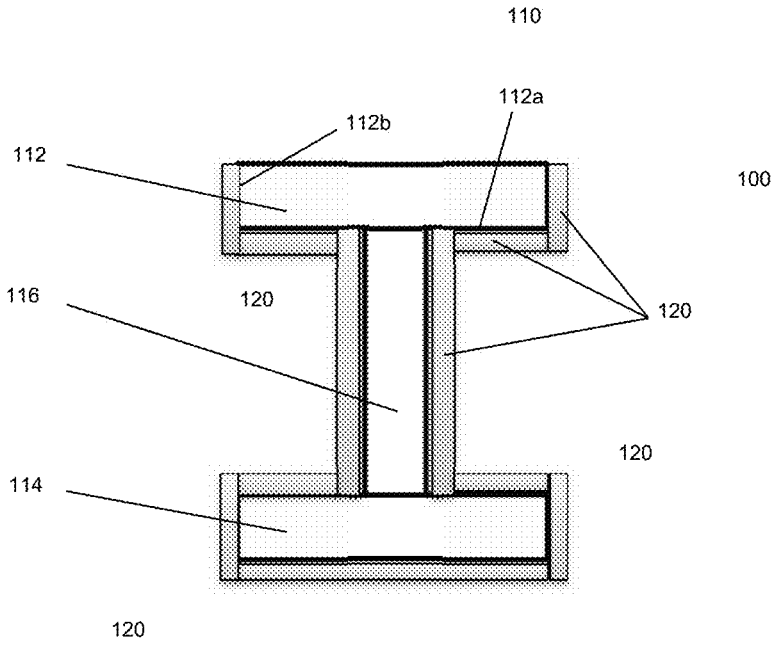
FIG. 3 illustrates an I-joist with solid fire-resistant cladding material in accordance with some embodiments described herein.

FIG. 3 illustrates another embodiment of the building product 100 in which additional portions of the cladding material 120 may be disposed on the bottom portions 112*a* and side portions 112*b* of top flange 112 in addition to the cladding shown in FIG. 2 such that 100% of the exposed surfaces of the structural member 110 are covered by the cladding material 120. Note that in some embodiments, the top portion of the top flange 112 is not covered with cladding material 120 since it abuts a ceiling or the like and is therefore not an exposed surface.

Figure 4:
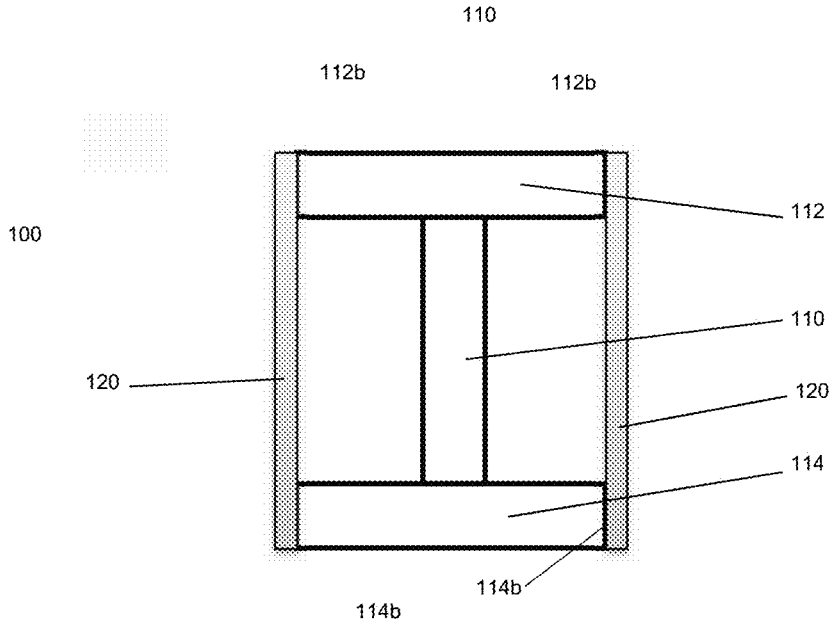
FIG. 4 illustrates an I-joist with solid fire-resistant cladding material in accordance with some embodiments described herein.

FIG. 4 illustrates an alternative embodiment of the building product in which the cladding material 120 is disposed on the structural member 110 such that the cladding material 120 encases the web 116. In such embodiments, the cladding material 120 extends from the side surface 112*b* of the top flange 112 to the side surface 114*b* of the bottom flange 114 on both sides of the structural member 110.

Figure 5:
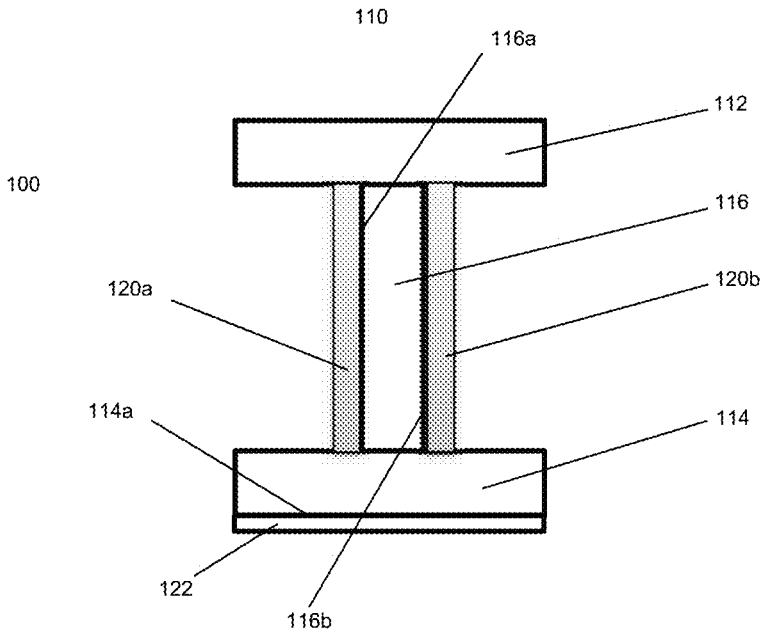
FIG. 5 illustrates an I-joist with solid fire-resistant cladding material in accordance with some embodiments described herein.

In some embodiments, the fire resistance of a building product, such as an I-joist, may be improved using a combination of the cladding material described herein and other fire-resistant coating materials. For example, with reference to FIG. 5, the first and second portion of the cladding material 120*a-b* are attached to the first and second web surfaces 116*a-b* as described above with reference to FIG. 1, and the bottom surface 114*a* of bottom flange 114 is also coated with a fire-resistant coating 122, such as an latex-based intumescent fire-resistant coating. The fire-resistant coating can also be applied to any other surfaces, in any combination.

Although FIGS. 1-5 show several configurations for disposing cladding material (and optionally fire-resistant coating) on various surfaces of an I-joist structural member, it should be appreciated that numerous other configurations are possible, where any combination of exposed surfaces are partially or fully covered by any combination of cladding material and fire-resistant coating.

Figure 6:
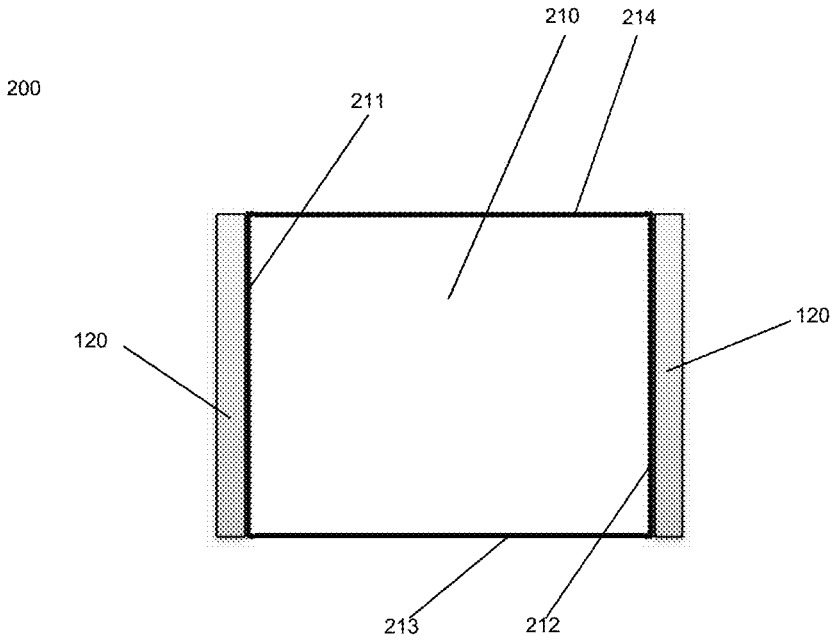
FIG. 6 illustrates a building product with solid fire-resistant cladding material in accordance with some embodiments described herein.
Figure 7:
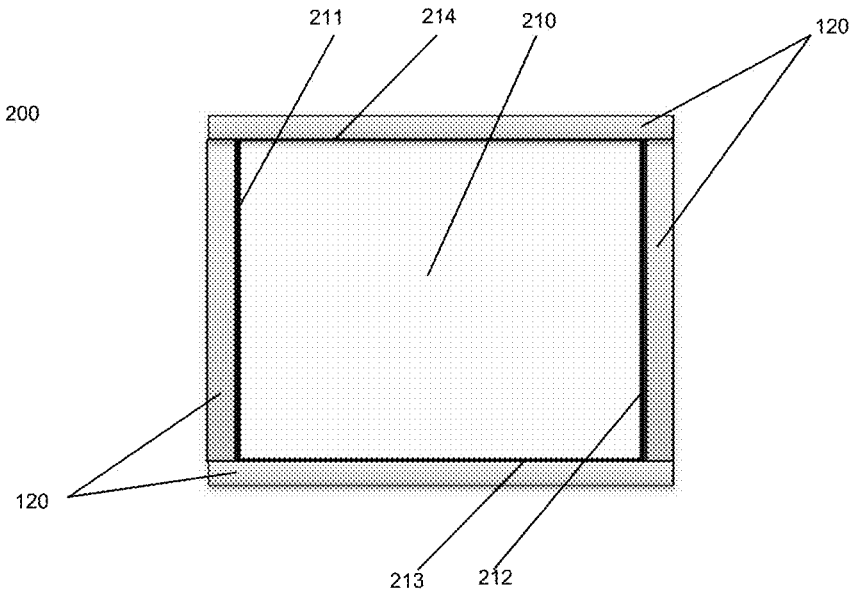
FIG. 7 illustrates a building product with solid fire-resistant cladding material in accordance with some embodiments described herein.

FIGS. 6 and 7 show building products 200 in accordance with the other embodiments of the present technology in which solid fire-resistant cladding materials are disposed on structural members 210 other than I-joists. Specifically, the building products 200 include structural members 210 such as joists made from a square or rectangular wood beam. In these embodiments, the structural member 210 includes a first side 251, a second side 252 opposite the first side 251, a bottom side 253, and a top side 254 opposite the bottom side 253. The structural member 210 may be any type of wood product, including but not limited to solid sawn lumber, parallel strand lumber (PSL), oriented strand board (OSB), oriented strand lumber, laminated veneer lumber (LVL), laminated strand lumber (LSL), particleboard, and medium density fiberboard (MDF). In FIG. 6, only the side surfaces 251 and 252 are covered with the fire-resistant cladding material 120. In FIG. 7, the side surfaces 251, 252, the bottom side 253, and top side 254 are all covered by the solid fire-resistant cladding material 120 to fully encase the structural member 210.

As with the building products shown in FIGS. 1-5, any combination of surfaces of the structural members 210 shown in FIGS. 6 and 7 can be partially or fully covered by any combination of cladding material and fire-resistant coating. In some embodiments, it may be desirable to refrain from disposing the solid cladding material on a surface that is secured to other building products, so as to not interfere connecting or fastening the building product to other building products.

Various benefits can be provided by the solid fire-resistant cladding material disposed on the building product. In some embodiments, the cladding material provides low flame spread to the building product. As used herein, the term "low flame-spread" refers to a treated state of the building product wherein the building product is rated at least Class A (10 minute burn) using the E84 test. In some embodiments, the cladding material provides a Class A rating with a 20 minute extension, thereby making it equivalent to fire retardant treated wood. To obtain a Class A rating, the flame cannot travel more than 10.5 feet in a 10 minute period. For the 20 minute extension, the flame cannot travel past 10.5 feet in 30 minutes.

Other benefits provided by the cladding material disposed on the building product can include improved fire endurance. Referring to Example 1 and Table 1 below, the cladding material increases the time the building product reaches 400° F. as compared to with no cladding while also provides a lighter weight material than other fire-resistant materials.

EXAMPLE 1

Fire Endurance of Wood Products Having Fire-Resistant Cladding Materials Applied Thereto Eleven fire resistant materials (both coatings and cladding materials) were attached on one face of an Oriented Strand Board (OSB) and tested in a single open flame Bunsen burner device to determine the burn-through rate of the material. A thermocouple was inserted at the mid-depth of the OSB to determine temperature change. The time that it took for the OSB to reach 400° F. was recorded. It was found that this type of test can be used as a screening test to predict the performance of the protected OSB in a full scale ASTM E-119 test.

Table 1 shows the results of this test. In Table 1, Isoltop® HD and SECURpan® are solid fire-resistant cladding materials manufactured by Matériaux Spécialisés Louiseville, Inc. and that are consistent with the solid fire-resistant cladding material disclosed herein; Flak Jacket® is a fire resistant coating manufactured by the Weyerhaeuser Company; N.C.F.R. Homasote® is a fire-resistant material manufactured by the Homasote Company; Structodek® is a wood-based fiberboard product manufactured by Blue Ridge Fiberboard; Z5 is a low density OSB developed by Weyerhaeuser; MDF is medium density fiberboard obtained from a local supplier; PB is a wood-based particleboard material obtained from a local supplier; None is OSB without any cladding or coating; and W9007 is a Weyerhaeuser waterborne formulation referenced in U.S. Published Patent Application No. 2015/0111052, the entirety of which is hereby incorporated by reference. The W9007 coating was applied at an application level of about 0.15 g/in$^2$. The coating was applied in a manual fashion with a roller and was allowed to cure in an oven (low temperature drying) prior to testing.

TABLE 1

| Fire Resistant Material | Fire Resistant Material Density (lbs/ft$^3$) | Web | Time to 400° F. (mins) |
|---|---|---|---|
| None | N/A | 7/16" Arcadia Web | 4.5 |
| FlakJacket ® | 60 | 7/16" Arcadia Web | 21.1 |
| 1/2" Gypsumboard | 34 | 7/16" Arcadia Web | 24.0 |
| 1/2" Isoltop ® HD | 17 | 7/16" Arcadia Web | 18.0 |
| 1/2" SECURpan ® | 17 | 7/16" Arcadia Web | 20.0 |
| 1/2" N.C.F.R. Homasote ® | 33 | 3/8" HB Web | 27.0 |
| 1/2" Cement Board | 76 | 3/8" HB Web | 22.0 |
| 1/2" Structodeck ®HD | 16 | 7/16" Arcadia Web | 19.2 |
| 1/2" Structodeck ®HD with W9007 Coating | 16 | 7/16" Arcadia Web | 29.1 |
| 1/2" Z5 | 29 | 3/8" Arcadia Web | 23.7 |
| 1/2" MDF | 40 | 3/8" Arcadia Web | 24.6 |
| 1/2" PB | 44 | 3/8" Arcadia Web | 21.8 |

As shown from Table 1, improved fire endurance is achieved by the various cladding materials tested as compared to when no coating or cladding is used. Table1 also shows that among the cladding materials tested, Isoltop®, SECURpan®, and Structodek® provide improved fire endurance characteristics along with low density.

EXAMPLE 2

Fire Endurance of I-Joist with Cladding and Coating Materials

A solid fire-resistant cladding material in accordance with the cladding material described herein and fire-resistant coating according to embodiments of the disclosure were evaluated to determine the ability to carry a structural load for an extended period of time when exposed to fire. Two I-joists were provided, and the web of each I-joist was covered with cladding material while the side surfaces of the bottom flange were coated with fire-resistant coating. Table 2A below describes the components of the samples used in this test.

TABLE 2A

| Sample | I-Joist | Cladding | Coating |
|---|---|---|---|
| I-Joist floor with fire-resistant cladding on web and fire-resistant coating on bottom flange | 2 Series 210-9 ½" TJIs with 7/16" web and 2 1/16" × 1 3/8" flange | ½" Blue Ridge Fiberboard with approximately 2% by weight carbon black dye and clay coated surface | Graphite-enhanced water based intumescent fire-resistant coating |

Preparation of Fire-Resistant Coating: A graphite-enhanced water based intumescent coating (Weyerhaeuser code name W9007.16) contained the following components by weight of the total formulation: 84% W9007 (formulation as set forth above in Table 1A) and 16% Asbury 3772 expandable graphite particles. This mixture was stirred gently by hand prior to its use.

Application of Cladding and Coating: Two TJI 210 wooden I-joists (14 feet long) were obtained from the Weyerhaeuser Company NR (Federal Way, Wash.) for this experiment. These I-joist products (9.5 inch deep) were made with an OSB web (3/8 inch thick) and laminated veneer (LVL) flanges (2.08 inch wide×1.375 inch deep). The 4'×8' fiberboard cladding panels were obtained from a local distributor and were cut into strips approximately the height of the web (6.75") of the I-joist and then attached to either side of the web via steel staples in a staggered configuration providing a tight fit without gaps. The staples (wire size: 16 ga, length of legs: 1", crown width: 1") were oriented vertically and spaced 24" on center top and bottom (1" distance from the edge of the flange) in a staggered configuration. Two staples, top and bottom, were used to connect the fiberboard cladding strips to the I-joist web at a seam located 1" from the end of the fiberboard cladding strip. One staple was used to connect the fiberboard cladding strip to the I-joist web at a location of a hole on both sides of the hole. Then, the exposed side surfaces of the bottom flange were coated with the fire resistant material W9007.16. The W9007.16 fire-resistant coating was applied at an application level of about 0.54 g/in$^2$. The coating was applied to the I-joists in a manual fashion with a roller and was allowed to cure at a temperature of 20° C. for a period of about one week prior to testing. Neither the top or bottom faces of the top and bottom flanges were coated.

Procedures: The I-joists were tested under procedures described in ASTM E119. The two I-joists were built into a fully-exposed floor assembly as prescribed in ASTM E119. Each assembly was loaded to 50% of its moment capacity and exposed to fire and elevated temperature under the conditions prescribed in ASTM E119. Each sample was then observed to determine the length of time it could sustain the structural load before catastrophic failure. Generally, conventional uncoated wooden I-joists subjected to these same test conditions will typically fail in about 4 minutes. The samples in this experiment were able to sustain the structural load for a period of time that exceeded 17 minutes. Table 2B below summarizes the result for one of the two samples.

TABLE 2B

| Sample | Time Before Failure (min:seconds) |
|---|---|
| Floor 1 | 17:35 |

EXAMPLE 3

Fire Endurance of I-Joist with Cladding Materials

A solid fire-resistant cladding material in accordance with the cladding material described herein was evaluated to determine the ability to carry a structural load for an extended period of time when exposed to fire. Two I-joists were provided, and the web of each I-joist was covered with the fire-resistant cladding material. Table 3A below describes the components of the samples used in this test.

TABLE 3A

| Sample | I-Joist | Cladding | Coating |
|---|---|---|---|
| I-Joist floor with fire-resistant cladding on both faces of the web | 2 Series 210-9 ½" TJI with 7/16" web and 2 1/16" × 1 3/8" flange | ½" Blue Ridge Fiberboard with approximately 2% by weight carbon black dye and clay coated surface | None |

Application of Cladding Material: Two TJI 210 wooden I-joists (14 feet long) were obtained from the Weyerhaeuser Company NR (Federal Way, Wash.) for this experiment. These I-joist products (9.5 inch deep) were made with an OSB web (3/8 inch thick) and laminated veneer (LVL) flanges (2.08 inch wide×1.375 inch deep). The 4'×8' fiberboard cladding panels were obtained from a local distributor and were cut into strips approximately the height of the web (6.75") of the I-joist and then attached to either side of the web via steel staples in a staggered configuration providing a tight fit without gaps. The staples (wire size: 16 ga, length of legs: 1", crown width: 1") were oriented vertically and spaced 24" on center top and bottom (1" distance from the edge of the flange) in a staggered configuration. Two staples, top and bottom, were used to connect the fiberboard cladding strips to the I-joist web at a seam located 1" from the end of the fiberboard cladding strip. One staple was used to connect the fiberboard cladding strip to the I-joist web at a location of a hole on both sides of the hole.

Procedures: The I-joists were tested under procedures described in ASTM E119. The two I-joists were built into a fully-exposed floor assembly as prescribed in ASTM E119. Each assembly was loaded to 50% of its moment capacity and exposed to fire and elevated temperature under the conditions prescribed in ASTM E119. Each sample was then observed to determine the length of time it could sustain the structural load before catastrophic failure. Generally, conventional uncoated wooden I-joists subjected to these same test conditions will typically fail in about 4 minutes. The samples in this experiment were able to sustain the structural load for a period of time that exceeded 15 minutes. Table 3B below summarizes the results for one of the samples.

TABLE 3B

| Sample | Time Before Failure (min:seconds) |
|---|---|
| Floor 2 | 15:34 |

EXAMPLE 3

Water Resistance of Cladding Materials

Other benefits provided by the cladding material disposed on the building product can include improved water resistance. As used herein, the term "water resistance" refers to a treated state of the building product wherein the building product passes a "24-hour water soak test" as described in Examples 3 and 4, Table 4, and FIGS. 8 and 9.

Four fire resistant materials were prepared and placed in a water tank to measure the water absorption and thickness swell properties of the materials. A control OSB panel was used as well for comparison.

TABLE 4

| Product | 24 hr WA (%) | 24 hr Mass Water Absorbed (g) | 24 hr Edge TS (%) | 24 1" in TS (%) | 24 hr Center TS (%) | Re-dry Edge TS (%) | Re-dry 1" in TS (%) | Re-dry Center TS (%) |
|---|---|---|---|---|---|---|---|---|
| ½" SECURpan ® | 64.1 | 48.5 | 14.0 | 13.6 | 13.0 | 2.6 | −0.1 | −0.4 |
| ½" Isoltop ® | 55.5 | 43.6 | 12.8 | 10.5 | 10.0 | 1.0 | −1.3 | −1.6 |
| ½" Drywall | 64.6 | 102.3 | 2.6 | 2.6 | 2.5 | 0.4 | −0.6 | −0.4 |
| ½" Fiberboard (Blue Ridge Sound) | 38.1 | 29.2 | 9.1 | 7.8 | 7.2 | −1.4 | −2.7 | −2.8 |
| 7/16" OSB Web | 22.8 | 43.4 | 18.5 | 10.9 | 8.4 | 9.8 | 5.0 | 4.4 |

Table 4 shows the water absorption and thickness swell characteristics of the various fire resistant materials in comparison to the control OSB panel. The 24 hour water gain of all wood-based materials considered in the study are similar or lower than that of the control and much lower than that of the drywall but the thickness swell of such materials before and after re-dry is considerably lower than that of the OSB control.

Example 4

Water Gain and Drying Rate of Cladding Materials

Construction materials typically get wet during the construction cycle. The ability of a construction material to dry quickly is a desirable characteristic, as this helps to prevent mold or other water related problems. Thus, the ability of the cladding material described herein to dry quickly was tested. Three fire resistant cladding materials were attached to OSB panels via steel staples and the composite structures were placed in a rain room for 3 hrs. The initial weight prior to rain exposure was measured and recorded. The control was an OSB panel without cladding. The water accumulation was ¼" per hour. After the 3 hours of rain exposure, the composite structures were removed, taken apart and the weight of each component measured and recorded. Then, all materials were placed in a 50% relative humidity room and the weight loss was monitored over time to determine drying rate.

Figure 8:
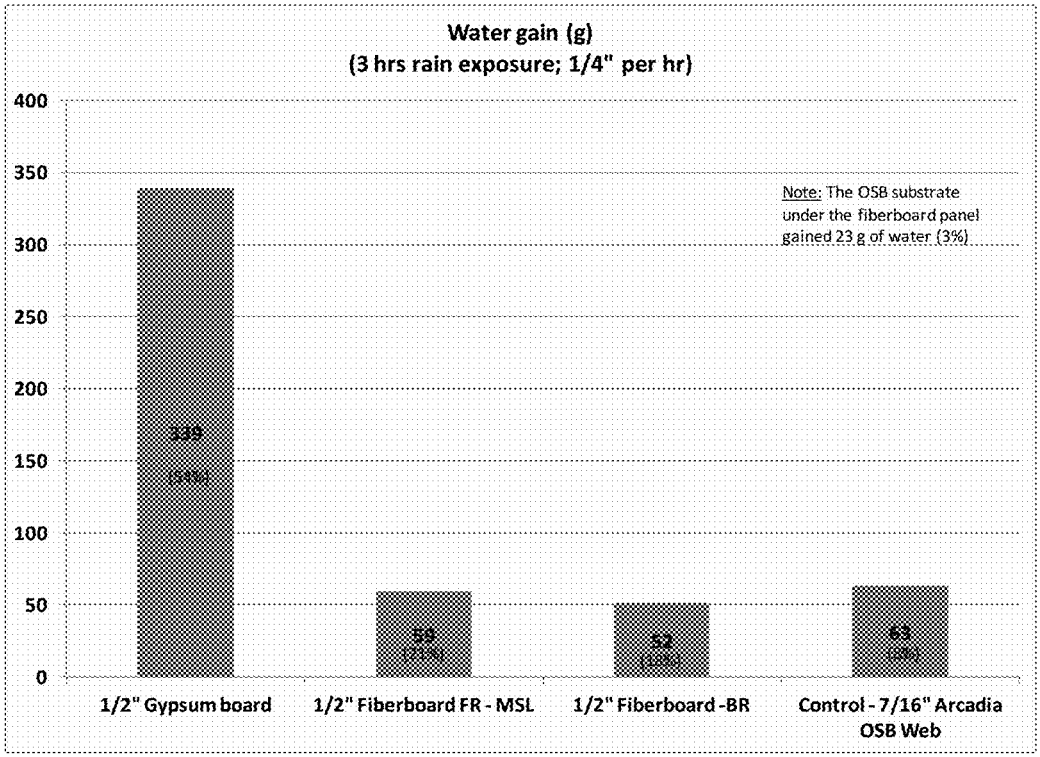
FIG. 8 is a graph illustrating water resistance of various fire-resistant cladding materials, including cladding materials according to various embodiments described herein.

FIG. 8 is a graph illustrating the water gain in each cladding material (including the control OSB panel) after 3 hours of rain exposure at ¼" of water accumulation per hour. The data shows that the net water gain of the wood-based claddings is much lower than that of the drywall but not significantly different than that of the OSB control.

Figure 9:
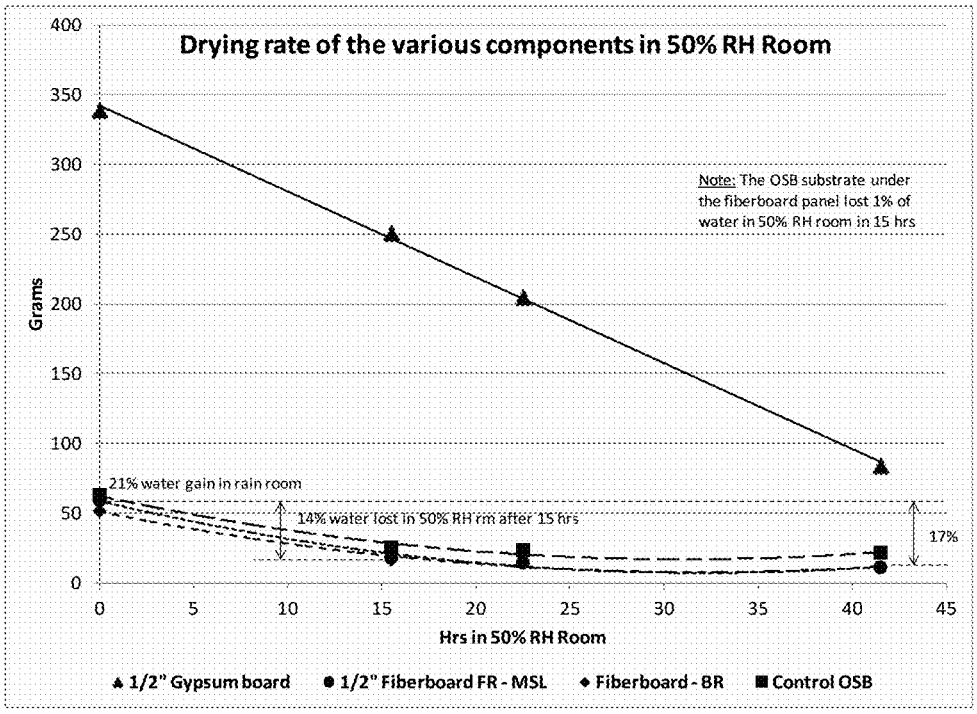
FIG. 9 is a graph illustrating drying rates of various fire-resistant cladding materials, including cladding materials according to various embodiments described herein.

FIG. 9 is a graph illustrating the drying rate of the various materials in the 50% relative humidity room. As shown, over half of the water gained by the cladding material was lost within the first 10 hrs in the 50% relative humidity room. The initial drying rate of the wood-based fire-resistant claddings is higher than that of the OSB control and more than twice the initial drying rate of drywall.

From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. A fire-resistant budding product comprising:

a wooden I-joist comprising a web, a top flange along a top edge of the web, and a bottom flange along a bottom edge of the web: and a solid fire-resistant cladding material disposed directly on at least one side of the web and an opposing side of the web, wherein the solid fire-resistant cladding material comprises wood fiber matrix and one or more binders, wherein the one or binder comprises a wax emulsion or a paraffin emulsion; and wherein the solid fire-resistant cladding material has a permeability greater, than 20 perms.

2. The fire-resistant building product of claim 1, wherein the solid fire-resistant cladding material further comprises starch.

3. The fire-resistant building product of claim 1, wherein the solid fire-resistant cladding material is further disposed directly on a bottom side of the bottom flange.

4. The fire-resistant building product of claim 1, wherein the solid fire-resistant cladding material comprises 50 to 99 wt % wood fiber matrix and 1 to 10wt % binder.

5. The fire-resistant building product of claim 1, wherein a fire-retardant coating is applied to an external surface of the fire-resistant cladding material or an exposed surface of the wooden I-joist.

6. The fire-resistant building product of claim 1, wherein the solid fire-resistant cladding material has a density in the range of 12 to 25 lbs/ft$^3$.

7. The fire-resistant building product of claim 1, wherein the solid fire-resistant cladding material has a drying rate greater than 60%/hour.

8. A method of manufacturing a fire-resistant building product having at least one surface, comprising:

attaching a solid fire-resistant cladding material on a wooden Hoist comprising a web, a top flange along a top edge of the web, and a bottom flange along a bottom edge of the web, wherein the solid fire-resistant cladding material comprises a pre-formed component, wherein the solid fire-resistant cladding material is attached directly to at least one of the surfaces of the web, wherein the solid fire-resistant cladding material comprises wood fiber matrix and one or more binders, wherein the one or more binder comprising a wax emulsion or a paraffin emulsion; and wherein the solid fire-resistant cladding material has a permeability, greater than 20 perms.

9. The method of claim 8, wherein the solid fire-resistant cladding material is attached directly to both surfaces of the web.

10. The method of claim 8, wherein the method further comprises:

applying a fire-resistant coating on an exposed surface of the wooden joist or on external surface of the solid fire-resistant cladding material.

11. The method of claim 8, wherein the solid fire-resistant cladding material comprises a first surface and a second surface opposite the first surface, and the method further comprises:

coating the first surface, the second surface, or both with a fire-resistant coating prior to attaching the solid fire-resistant cladding material on the at least one surface of the web.

12. The method of claim 8, wherein the method further comprises:

coating a fire-resistant coating on an exterior surface of the solid fire-resistant cladding material after attaching the solid fire-resistant cladding material on the at least one surface of the web.

13. A fire-resistant building product comprising:

a wooden I-joist comprising a web, a top flange along a top edge of the web, and a bottom flange along a bottom edge of the web; and a solid fire-resistant cladding material disposed directly on at least one side of the web and an opposing side of the web, wherein the solid fire-resistant cladding material comprises wood fiber matrix and one or more binders, wherein the binder comprises a wax emulsion or a paraffin emulsion; and wherein the solid fire-resistant cladding material has a drying rate greater than 60%/hour.

14. The fire-resistant building product of claim 13, wherein the solid fire-resistant cladding material further comprises starch.

15. The fire-resistant building product of claim 13, wherein the solid fire-resistant cladding material is further disposed directly on a bottom side of the bottom flange.

16. The fire-resistant building product of claim 13, wherein the solid fire-resistant cladding material comprises 50 to 99 wt % wood fiber matrix and 1 to 10wt % binder.

17. The fire-resistant building product of claim 13, wherein a fire-retardant coating is applied to an external surface of the fire-resistant cladding material or an exposed surface of the wooden I-joist.

18. The fire-resistant building product of claim 13, wherein the solid fire-resistant cladding material has a density in the range of 12 to 25 $lbs/ft^3$.

19. A method of manufacturing a fire-resistant building product having at least one surface, comprising:

attaching a solid fire-resistant cladding material on a wooden I-joist comprising a web, a top flange along a top edge of the web, and a bottom flange along a bottom edge of the web, wherein the solid fire-resistant cladding material comprises a pre-formed component, wherein the solid fire-resistant cladding material is attached directly to at least one of the surfaces of the web, wherein the solid fire-resistant cladding material comprises wood fiber matrix and one or more binders, wherein the one or more binder comprises a wax emulsion or a paraffin emulsion; and wherein the solid fire-resistant cladding material has a drying rate greater than 60%/hour.

20. The method of claim 19, wherein the solid fire-resistant cladding material is attached directly to both surfaces of the web.

21. The method of claim 19, wherein the method further comprises:

applying a fire-resistant coating on an exposed surface of the wooden joist or on external surface of the solid fire-resistant cladding material.

22. The method of claim 19, wherein the solid fire-resistant cladding material comprises a first surface and a second surface opposite the first surface, and the method further comprises:

coating the first surface, the second surface, or both with a fire-resistant coating prior to attaching the solid fire-resistant cladding material on the at least one surface of the web.

23. The method of claim 19, wherein the method further comprises:

coating a fire-resistant coating on an exterior surface of the solid fire-resistant cladding material after attaching the solid fire-resistant cladding material on the at least one surface of the web.

* * * * *